US005860629A

United States Patent [19]

Reed

[11] Patent Number: 5,860,629

[45] Date of Patent: Jan. 19, 1999

[54] CLIMBING AID HAVING MOVABLE AXLE

[76] Inventor: Max W. Reed, 822 E. 28th St., Eugene, Oreg. 97405

[21] Appl. No.: 926,286

[22] Filed: Sep. 5, 1997

Related U.S. Application Data

[60] Provisional application No. 60/025,424 Sep. 6, 1996.

[51] Int. Cl.[6] ..... A47F 5/08

[52] U.S. Cl. ..... 248/231.9; 248/925

[58] Field of Search ..... 248/925, 231.9; 482/37

[56] References Cited

U.S. PATENT DOCUMENTS

| | | | |
|---|---|---|---|
| 4,184,657 | 1/1980 | Jardine | 248/925 X |
| 4,575,032 | 3/1986 | Taylor | 248/925 X |
| 4,643,377 | 2/1987 | Christianson | 248/231.9 |
| 4,645,149 | 2/1987 | Lowe | 248/925 X |
| 4,781,346 | 11/1988 | Banner | 248/925 X |

FOREIGN PATENT DOCUMENTS

| | | | |
|---|---|---|---|
| 3717027 | 12/1988 | Germany | 248/925 |

*Primary Examiner*—Ramon O. Ramirez
*Attorney, Agent, or Firm*—Steven J. Adamson

[57] ABSTRACT

A climbing aid apparatus that includes cams that are mounted for rotation about axles. At least one of the axles is capable of relative movement. In a preferred embodiment, the position of at least one axle moves as the cams expand. An embodiment including three axles is also disclosed.

18 Claims, 2 Drawing Sheets

CLIMBING AID HAVING MOVABLE AXLE

RELATED APPLICATION

This application is a continuation of provisional application Ser. No. 60/025,424, filed Sep. 6, 1996.

FIELD OF THE INVENTION

The present invention relates to rock climbing equipment used to provide reasonable anchor in a crack or feature in rock.

BACKGROUND OF THE INVENTION

A specific class of climbing gear, known as active protection, is spring loaded so as to provide engagement, even in parallel-sided or slightly flaring cracks. Spring loaded camming devices, SLCD, are the most common type of active protection. Cam members rotate on the end of a load stem. The cams are spring loaded outwards to provide engagement in the crack. A trigger is connected to the cams with small cables to facilitate placement and removal from the crack.

A SLCD is described by U.S. Pat. No. 4,184,657, issued to Raymond Jardine in 1980, and entitled Climbing Aids. This patent teaches a climbing aid comprising a support bar, a spindle mounted on the support bar, at least two cam members pivotally mounted on the spindle and adapted for opposite pivotal movement from a "closed" position to an "open" position, an operating bar slidably mounted on the support bar and connected to each cam member and there being at the opposite end of the support bar to the spindle an attachment point for a climbing rope.

At the time of its invention, the SLCD concept was a great improvement over current technology (chock stones and the like) because it allowed a single piece of protection to be viable over a range of crack sizes. Also, the SLCD enabled secure protection in parallel sided cracks which were previously deemed unprotectable.

Another invention relating to the SLCD is described by U.S. Pat. No. 4,643,377, issued to Tony Christianson in 1987, and entitled Mechanically Expanding Climbing Aid. This patent teaches a climbing aid which includes opposing cam members, two fixed parallel axles on which the opposing cam members pivot separately with crossed radii, an axle joining member, means for attachment of a climbing rope, spring members which act to move the cam members toward their fully expanded positions, and an operating member which is connected to each cam member such that when it is pulled the cam members retract in order to allow insertion or removal of the improved climbing aid into or out of a crack in rock. A distinguishing feature of the device of Christianson is that two axles are provided. The effect of having two axles is that larger cams and larger cam spacing can be utilized (with the same minimum expansion size as in single axle devices), thus providing a larger maximum expansion.

Of great importance to climbers is the range of expansion of a particular piece climbing aid, where range of expansion is the distance between minimum and maximum cam expansion widths. In order to compare the present invention to prior art devices the term expansion ratio (ER) is now defined as:

ER=maximum expansion width/minimum expansion width

The single axle type has a lower ER than the double axle type. The minimum and maximum expansion of a single axle SLCD are determined wholly by the size of the cams. The average ER of commercial single axle SLCD is approximately 1.55.

The minimum and maximum expansions of a double axle SLCD are determined by cam size and the spacing of the axles. The average ER of commercial double fixed axle SLCD is approximately 1.67. A need exists for a climbing aid with a greater ER.

SUMMARY OF THE INVENTION

Accordingly, it is an object of the present invention to provide a climbing aid that has an improved expansion ratio (ER) compared to prior art climbing aids.

It is another object of the present invention to provide a climbing aid that includes a cam axle that is translated during expansion of the climbing aid's cams.

It is also an object of the present invention to provide a climbing aid in which a cam axle is translatable with respect to the load stem.

These and related objects of the present invention are achieved by use of a climbing aid apparatus having movable axle as disclosed herein.

In one embodiment, the present invention includes a first cam that pivots about a first axle; a second cam that pivots about a second axle; axle mounting member; rope attachment member; and means for expanding and retracting said cams; wherein at least one of said axles is capable of relative movement. This movement may be relative to the other axle or to the axle mounting member and is preferably proportional to expansion of at least one of the cams. The first axle may comprise first and second axle segments.

In another embodiment, the present invention includes a first cam that pivots about a first axle; a second cam that pivots about a second axle; axle mounting member; rope attachment member; and means for expanding and retracting said cams; wherein said first axle moves as at least one of said cams moves through its range of expansion.

In yet another embodiment, the present invention includes a first cam that pivots about a first axle; a second cam that pivots about a second axle; a third cam that pivots about a third axle; axle mounting means; cam expansion and retraction means; and rope attachment means.

The attainment of the foregoing and related advantages and features of the invention should be more readily apparent to those skilled in the art, after review of the following more detailed description of the invention taken together with the drawings.

DETAILED DESCRIPTION

Figure 1A:
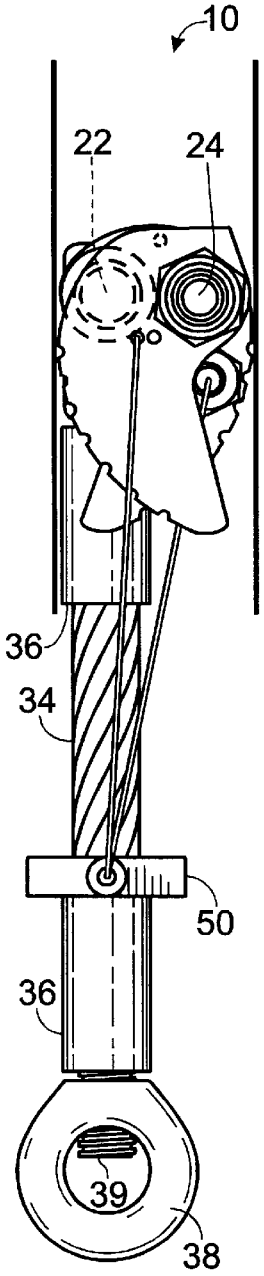
FIGS. 1A–1C are narrow side views of a climbing aid in accordance with the present invention in various stages of expansion.
Figure 1B:
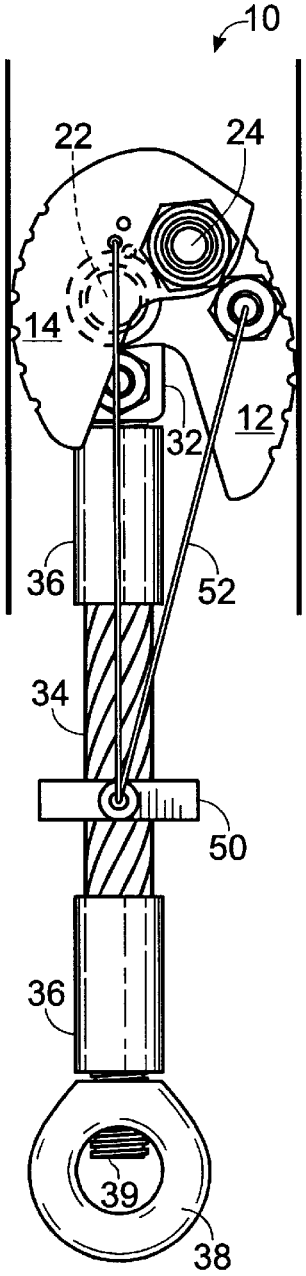
Figure 1C:
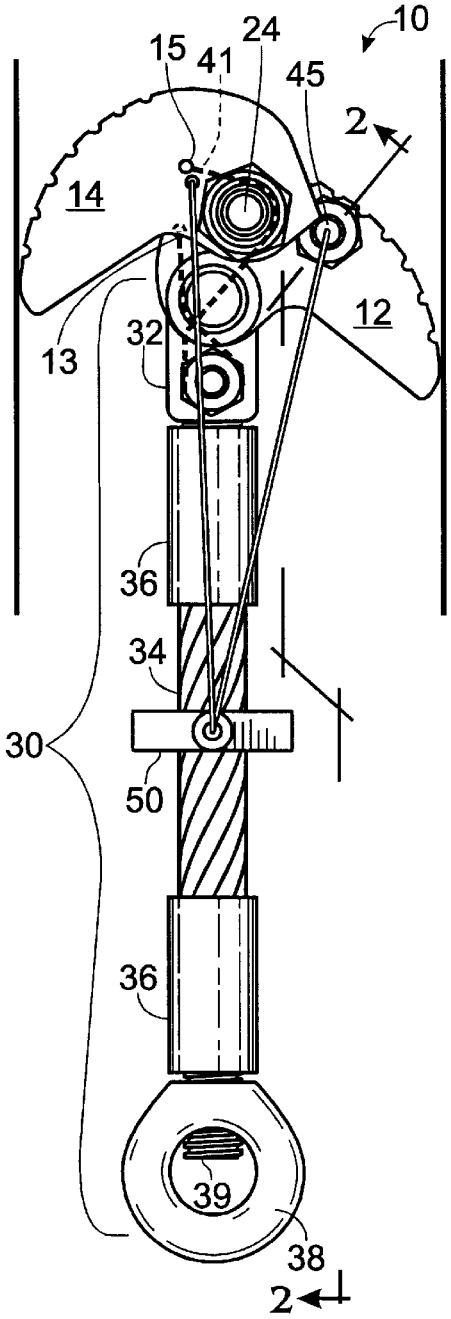

Referring to FIGS. 1A–1C, three narrow side views of a climbing aid in accordance with the present invention in various stages of expansion are shown. FIG. 1A illustrates the minimum expansion width, while FIG. 1B illustrates an intermediate width and FIG. 1C illustrates the maximum expansion width.

The climbing aid 10 preferably includes an inner pair of cams 12 and an outer pair of cams 14. Only one of each pair is visible in the perspective view of FIGS. 1A–1C and hence the reference numerals 12 and 14 are intended herein to represent both a single cam or the pair of cams as appropriate. Cam 12 rotates about axle 22 while cam 14 rotates about axle 24. Axle 24 is preferably provided through and supported by cam 12 so that the position of axle 24 moves as cam 12 moves through its range of expansion. Axle 24 is thus moved or rotated in the direction of arrow A by outward movement (expansion) of cam 12. Movement of axle 24 permits climbing aid 10 to achieve an improved ER.

Axle 22 is provided through an axle block 32 (discussed in more detail below) which in conjunction with cable 34, swage fasteners 36 and rope attachment loop 38 preferably form the load stem 30. Cable 34 is of a type known in the art. The swage fasteners 36 are used to join threaded members 37 (shown in FIG. 2) and 39 to which the axle block 32 and rope attachment loop 38 are respectively coupled. It should be recognized that while the swage fasteners and threaded members are suitable for the prototype embodiment of the present invention herein disclosed, other suitable materials are known for fabrication of the load stem and these materials and their corresponding manufacturing techniques should be considered for commercial production.

Figure 2:
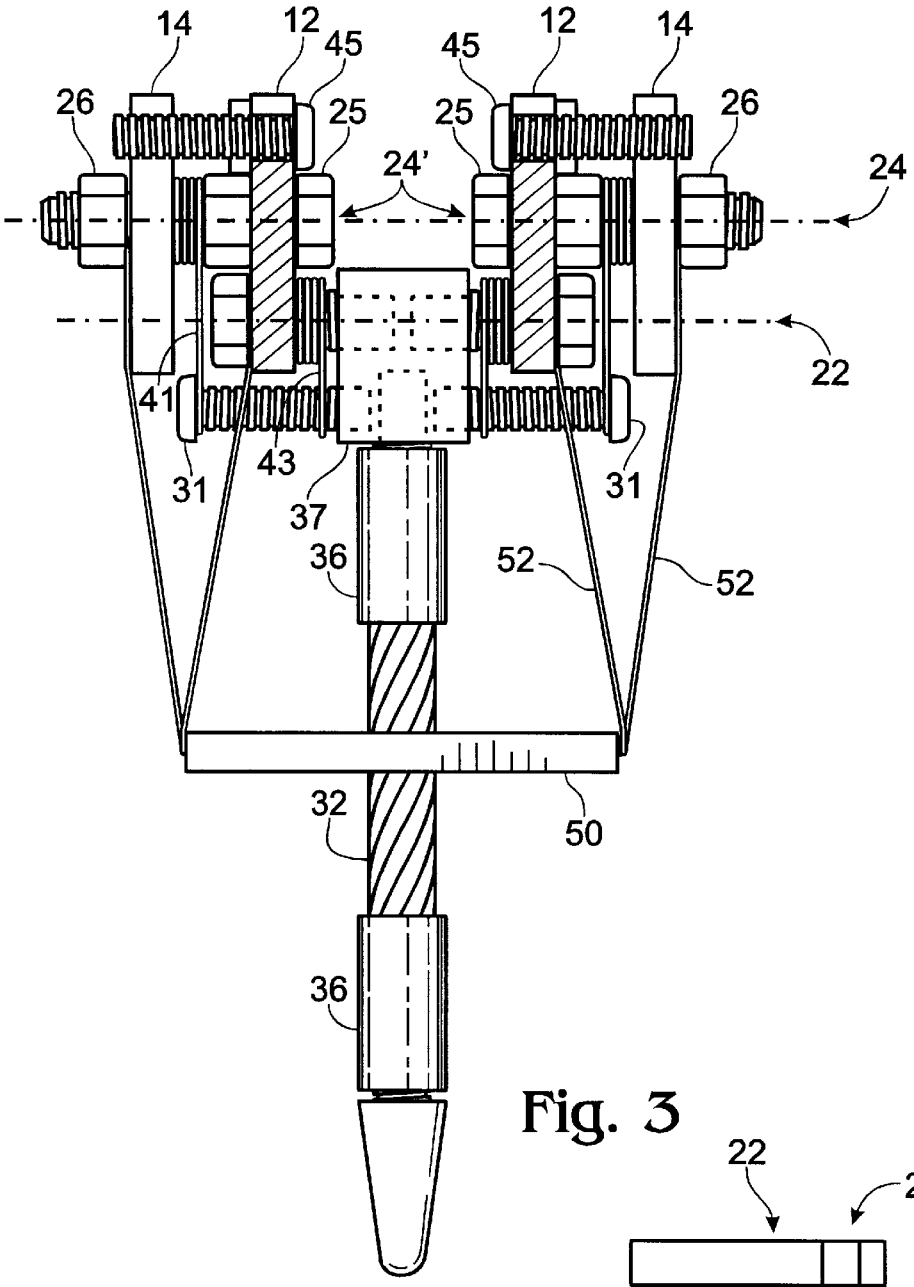
FIG. 2 is a broad side view of a climbing aid in accordance with the present invention taken along line 2—2 of FIG. 1C.

A plurality of springs are provided to bias the cams towards expansion. These springs are also shown in FIG. 2 discussed below. Spring 41 is biased against or otherwise coupled at one end to a spring stop bolt 31 and at the other end is coiled about axle 24 and connected to cam 14 through hole 15. Spring 43 is also biased against or otherwise coupled at one end to spring stop bolt 31 and at the other end is coiled about axle 22 and connected to cam 12 through hole 13.

A stop 45 is provided in cam 12 that prevents cam 14 from rotating past the "safe" range of expansion.

A trigger 50 is provided about load stem cable 34. Trigger cable 52 attach the cams to trigger 50 for retraction of the cams as is known in the art.

Referring to FIG. 2, a broad side view of climbing aid 10 taken along lines 2—2 of FIG. 1C is shown in accordance with the present invention. The perspective of FIG. 2 illustrates the preferred arrangement of inner and outer pairs of cams 12,14. Cams 12 are pivotally mounted on axle 22 and springs 43 bias them towards the expanded position. In the embodiment of FIG. 2, axle 22 is formed with two bolts 23 that are fixedly threaded into axle body 32.

Axle 24 which is preferably composed of two axle segments 24' is mounted to inner cams 12 (each segment 24' is mounted to one of the pair of cams 12). In addition to permitting translation, this arrangement also provided a degree of independent movement between the left side and right side sets of cams). Each of outer cam pair 14 is individually pivotally mounted to one of axle segment 24'. In the embodiment of FIG. 2, axle 24 is formed from two bolts 25 and lock nuts 26. Springs 41 bias cams 14 towards the expanded position.

Stoppers 45 are also fabricated from bolts. As noted above, the use of bolts and the like provides a successful prototype. Other manufacturing materials and techniques, however, such as those used to fabricate related climbing aids and the like should be considered in producing a commercial device. In any event, the components should be made of a material that provides requisite strength and reduced friction and wear, and is capable of withstanding environmental degradation.

Figure 3:
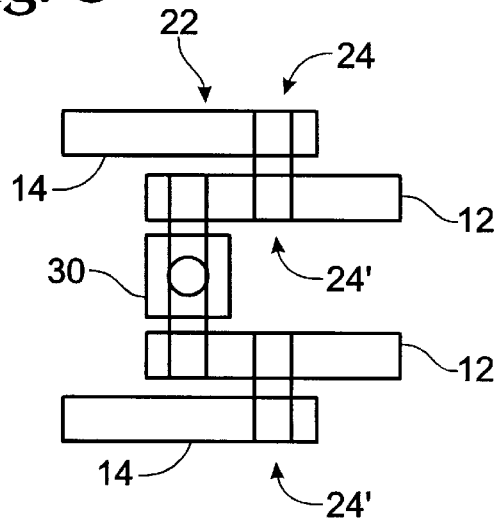
FIG. 3 is a top view of the climbing device of FIGS. 1A–1C and 2.

Referring to FIG. 3, a representative top view of climbing aid 10 in accordance with the present invention is shown. The view of FIG. 3 is intended primarily to illustrate the arrangement of the cams 12,14, axles 22,24 (and axle segments 24',24') and load stem 30. FIG. 3 illustrates climbing aid 10 in an approximate intermediate expansion position.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

What is claimed is:

1. A climbing aid apparatus, comprising:

a first cam that pivots about a first axle;

a second cam that pivots about a second axle;

axle mounting member;

rope attachment member; and means for expanding and retracting said cams;

wherein at least one of said axles is capable of movement relative to said axle mounting member.

2. The apparatus of claim 1, wherein said movement of said at least one of said axles is proportional to expansion of at least one of said cams.

3. The climbing and apparatus of claim 1, wherein said first axle is capable of movement relative to said second axle.

4. The climbing and apparatus of claim 1, wherein said second axle is mounted to said axle mounting member and said first axle is capable of movement relative to said axle mounting member.

5. The climbing and apparatus of claim 1, further comprising a load stem including said axle mounting member and wherein said first axle is capable of movement relative to said load stem.

6. The climbing and apparatus of claim 1, wherein said first axle is coupled to said second cam.

7. The climbing and apparatus of claim 1, wherein said first axle is comprised of first and second separate axle segments.

8. A climbing aid apparatus, comprising:

a first cam that pivots about a first axle;

a second cam that pivots about a second axle;

axle mounting member;

rope attachment member; and means for expanding and retracting said cams;

wherein said first axle moves as at least one of said cams moves through its range of expansion.

9. The apparatus of claim 8, wherein said axle moves relative to said axle mounting member.

10. The apparatus of claim 8, wherein said first axle is coupled to said second cam.

11. The apparatus of claim 8, wherein said second axle is mounted to said axle mounting member and said first axle moves relative to said axle.

12. The apparatus of claim 8, wherein said first axle is comprised of first and second separate axle segments having substantially collinear axis.

13. The apparatus of claim 8, wherein said first cam is part of a first pair of cams and said second cam is part of a second pair of cams.

14. A climbing aid apparatus, comprising;

a first cam that pivots about a first axle;

a second cam that pivots about a second axle;

a third cam that pivots about a third axle;

axle mounting means;

cam expansion and retraction means; and rope attachment means;

wherein said first, second and third axles are mutually distinct.

15. The apparatus of claim 14, wherein at least one of said axles is capable of relative movement.

16. The apparatus of claim 14, wherein at least two of said axles are capable of relative movement.

17. The apparatus of claim 14, wherein said second and third axles are capable of movement relative to said axle mounting means.

18. The apparatus of claim 14, wherein said first cam is part of a first cam pair, said second axle is mounted to a first of said pair and said third axle is mounted to a second of said pair.

* * * * *